US010406529B2

(12) United States Patent
Melick et al.

(10) Patent No.: US 10,406,529 B2
(45) Date of Patent: Sep. 10, 2019

(54) CONTINUOUS CONTAINED-MEDIA MICROMEDIA MILLING PROCESS

(71) Applicant: Sun Chemical Corporation, Parsippany, NJ (US)

(72) Inventors: Michael Ray Melick, Lebanon, OH (US); Donald C. Henderson, Loveland, OH (US)

(73) Assignee: Sun Chemical Corporation, Parsippany, NJ (US)

( * ) Notice: Subject to any disclaimer, the term of this patent is extended or adjusted under 35 U.S.C. 154(b) by 314 days.

(21) Appl. No.: 14/826,772

(22) Filed: Aug. 14, 2015

(65) Prior Publication Data

US 2016/0016176 A1 Jan. 21, 2016

Related U.S. Application Data

(63) Continuation of application No. PCT/US2014/019335, filed on Feb. 28, 2013.

(Continued)

(51) Int. Cl.

*B02C 17/16* (2006.01)
*B02C 17/20* (2006.01)
*B02C 23/12* (2006.01)

(52) U.S. Cl.

CPC ..... *B02C 17/161* (2013.01); *B02C 17/16* (2013.01); *B02C 17/20* (2013.01); *B02C 23/12* (2013.01)

(58) Field of Classification Search

CPC ..... B02C 17/161; B02C 17/16; B02C 17/20; B02C 23/12

(Continued)

(56) References Cited

U.S. PATENT DOCUMENTS 842,602 A * 1/1907 Wurdack ..... B01D 29/48 210/397
3,162,518 A * 12/1964 Thomas ..... B01D 53/86 96/136

(Continued)

FOREIGN PATENT DOCUMENTS

CH 0666832 A5 * 10/1984 ..... B02C 17/16
CH 666 832 8/1988

(Continued)

OTHER PUBLICATIONS

International Search Report and Written Opinion dated Jun. 20, 2014 for Application No. PCT/US2014/019335.

(Continued)

*Primary Examiner* — Shelley M Self
*Assistant Examiner* — Smith Oberto Bapthelus
(74) *Attorney, Agent, or Firm* — Scott Conley; Howard Lee

(57) ABSTRACT

An apparatus and continuous process for making milled solid in liquid dispersions comprises several steps: 1) Forming a pre-mill mixture of pre-mix, milling media, and previously milled dispersion. 2) Milling the pre-mill mixture to form a milled mixture of milling media and milled dispersion. 3) Separating a portion of the milled dispersion, which is substantially free of milling media, from the milled mixture. 4) Recycling the un-separated mixture by adding additional pre-mix to form the pre-mill mixture to create a continuous milling process. The pre-mix comprises a liquid and a solid. The process is a continuous process and the milling media is recycled through the milling step. Much of the milled dispersion is also cycled through the milling step several times and only a portion of the milled dispersion, which is substantially free of milling media, is removed as the milled dispersion product.

18 Claims, 3 Drawing Sheets

Related U.S. Application Data

(60) Provisional application No. 61/770,475, filed on Feb. 28, 2013, provisional application No. 61/860,316, filed on Jul. 31, 2013.

(58) Field of Classification Search
USPC ..... 241/21, 24, 24.1
See application file for complete search history.

(56) References Cited

U.S. PATENT DOCUMENTS 3,824,932 A * 7/1974 Aronson ..... B41F 27/06 101/377
3,834,982 A * 9/1974 Alexandrovich et al. ..... B01F 3/0807 134/1
4,065,060 A 12/1977 Booz
4,266,473 A 5/1981 Hunt et al.
4,397,230 A 8/1983 Hunt et al.
4,426,289 A 1/1984 Svehaug
4,709,628 A * 12/1987 Glowacki ..... B30B 9/18 100/117
5,022,592 A 6/1991 Zakheim et al.
5,145,684 A * 9/1992 Liversidge ..... A61K 9/145 424/489
5,152,891 A 10/1992 Netkowicz et al.
5,332,499 A 7/1994 Spencer
5,478,705 A * 12/1995 Czekai ..... B41M 5/38207 241/184
5,500,331 A * 3/1996 Czekai ..... B02C 17/20 241/184
5,513,803 A * 5/1996 Czekai ..... B02C 17/161 241/16
5,516,427 A * 5/1996 Yoshikawa ..... B01D 29/356 210/413
5,651,813 A * 7/1997 Santilli ..... C09D 11/326 106/31.67
5,662,279 A * 9/1997 Czekai ..... B02C 17/161 241/171
5,679,138 A * 10/1997 Bishop ..... C09D 11/322 106/31.65
5,718,388 A * 2/1998 Czekai ..... A61K 9/146 241/21
5,765,764 A * 6/1998 Barbic ..... G01R 33/44 241/21
5,865,997 A 2/1999 Isaacs
5,902,711 A 5/1999 Smith et al.
5,985,017 A 11/1999 Bugner et al.
6,053,438 A 4/2000 Romano, Jr. et al.
6,166,105 A 12/2000 Santilli et al.
6,210,474 B1 4/2001 Romano, Jr. et al.
6,281,268 B1 8/2001 Romano, Jr. et al.
6,634,576 B2 * 10/2003 Verhoff ..... A61K 9/14 241/184
7,441,717 B1 * 10/2008 Majka ..... B02C 17/166 241/15
7,631,821 B2 * 12/2009 Phillips ..... C01F 7/0613 241/21
7,967,947 B2 * 6/2011 Goto ..... D21B 1/325 162/21
8,303,826 B2 * 11/2012 Steiner ..... B01D 33/466 210/784
8,876,027 B2 * 11/2014 Oehr ..... B02C 17/20 241/1
2002/0104908 A1 * 8/2002 Berger ..... E03C 1/2665 241/21
2002/0119200 A1 * 8/2002 Haskell ..... A61K 9/14 424/489
2004/0166026 A1 * 8/2004 Bratcher ..... C07K 14/415 241/2
2006/0214037 A1 * 9/2006 Holland ..... A61K 9/14 241/21
2006/0249606 A1 * 11/2006 Hiraki ..... B01F 3/1207 241/21
2007/0199482 A1 * 8/2007 Kanai ..... B03B 9/063 106/638
2008/0078518 A1 * 4/2008 Goto ..... D21B 1/325 162/189
2011/0290922 A1 * 12/2011 Melick ..... B02C 17/163 241/30
2012/0160944 A1 * 6/2012 Dodd ..... A01N 25/12 241/30
2012/0165410 A1 * 6/2012 Dodd ..... A61K 9/145 514/569
2012/0289559 A1 * 11/2012 Niwa ..... B02C 19/186 514/391
2013/0289137 A1 10/2013 Ortalano
2016/0016176 A1 * 1/2016 Melick ..... B02C 17/16 241/21

FOREIGN PATENT DOCUMENTS

EP 0804161 11/1997
EP 1280604 2/2003
EP 1148990 B1 5/2006
EP 1759831 3/2007
JP 62-202343 U 12/1987
JP 2003-500206 A 1/2003
JP 2003-532525 A 11/2003
JP H04-022445 A 1/2004
JP 2007-264315 A 10/2007
WO WO 95/31973 11/1995
WO WO 2001/085345 11/2001

OTHER PUBLICATIONS

International Preliminary Report on Patentability dated Sep. 1, 2015 for Application No. PCT/US2014/019335.

* cited by examiner

CONTINUOUS CONTAINED-MEDIA MICROMEDIA MILLING PROCESS

CROSS REFERENCE TO RELATED APPLICATIONS

This application hereby claims the benefit of PCT/US2014/019335, filed on Feb. 28, 2014, which claimed benefit of the provisional patent application of the same title, Ser. No. 61/770,475, filed on Feb. 28, 2013; and the provisional patent application titled "Apparatus & Method for Separating Milling Media from Dispersion Fluid," Ser. No. 61/860,316, filed on Jul. 31, 2013; the disclosures of which are herein incorporated by reference in their entirety.

BACKGROUND

Conventional media milling uses a media that is denser than the fluid dispersion being milled which makes separation of the media and dispersion relatively easy. Under the influence of centripetal force, the denser media disproportionally populates the outer regions of the mill as the agitator rotates allowing the media-free dispersion to escape through the mill center under positive pressure. In the center is a small screen which ideally never encounters media as it is fragile and expensive to replace. The screen is primarily in place to prevent media discharge mishaps during startup/shutdown and stop the occasional stray media from leaving the milling chamber.

When the media and the dispersion are close in density, centripetal force no longer works efficiently as a separation method. This is generally the case when polymeric media is used. For this reason, polymeric media hasn't seen the wide application of ceramic media even though it has many compelling attributes such as increase energy efficiency, reduced mill wear, reduced metal contamination, and often superior particle size reduction at the same energy or throughput.

Tank or batch processes for creating dispersions with polymeric media require large quantities of media to be premixed with the pre-mix. After milling and media-dispersion separation, large quantities of dispersion-laden media remain. This media either needs to be cleaned or stored until a similar product is made again. Each time a product is changed, the media must be cleaned, which is not only laborious but also wastes 20-40% of the dispersion that clings to the media. Storing the dispersion-laden media in a warehouse for the next time the product is made requires a complex logistical plan, and additional chemicals must be used to prevent fungal and bacterial growth plus other potential contaminations. In a tank process, the batch size is limited because large tanks are required to hold the high media content dispersion-media mixes. Large tanks must be assembled on site rather than efficiently mass manufactured. There are also practical limitations to the size of a rotor stator or other high shear device regardless of tank size. A tank process is inherently a batch process which involves a milling step followed by a separation step.

Consequently, a significant need exists for ways to make polymeric media milled dispersions continuously that use small amounts of media which results in less dispersion waste and eliminates the storage/logistic and bacteria growth problems.

BRIEF SUMMARY

An apparatus and continuous process for making milled solid in liquid dispersions comprises several steps: 1) Forming a pre-mill mixture of pre-mix, milling media, and previously milled dispersion. 2) Milling the pre-mill mixture to form a milled mixture of milling media and milled dispersion. 3) Separating a portion of the milled dispersion, which is substantially free of milling media, from the milled mixture. 4) Recycling the un-separated mixture by adding additional pre-mix to form the pre-mill mixture to create a continuous milling process. The pre-mix comprises a liquid and a solid. The process is a continuous process and the milling media is recycled through the milling step. Much of the milled dispersion is also cycled through the milling step several times and only a portion of the milled dispersion, which is substantially free of milling media, is removed as the milled dispersion product.

The apparatus for the continuous process of making a milled solid dispersion in a liquid medium comprises a separator and a mill. The mill grinds a pre-mill mixture comprising a milling media and solid or semi-solid particles in a liquid medium to form a milled mixture of milled dispersion with milling media. The milled mixture is fed into the separator. The separator separates a portion of the milled dispersion, which is substantially free of contain milling media, from the milled mixture. The resulting un-separated mixture is fed directly or indirectly into the mill.

These aspects and its advantages shall be made apparent from the accompanying drawings and the description thereof.

BRIEF DESCRIPTION OF THE FIGURES

The accompanying drawings, which are incorporated in and constitute a part of this specification, illustrate embodiments, and together with the general description given above, and the detailed description of the embodiments given below, serve to explain the principles of the present disclosure.

DETAILED DESCRIPTION

Figure 1:
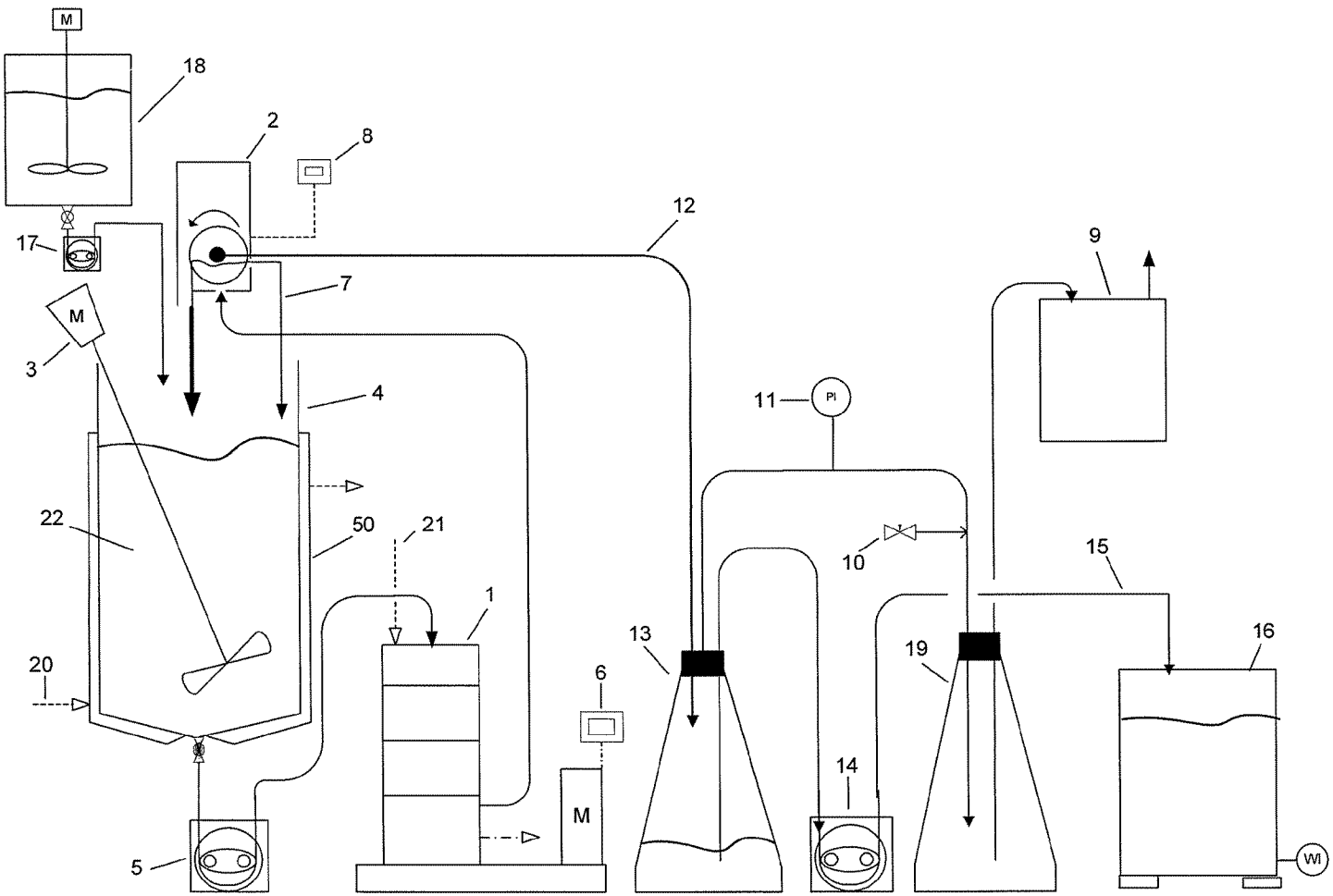
FIG. 1 is a schematic view of one embodiment of the apparatus and continuous process using a drum filter.

A continuous process for making milled solid in liquid dispersions uses a separation apparatus that continually removes a portion of the milled dispersion, which is substantially free of milling media, from the dispersion-media mixture. After the portion of finished or milled dispersion is removed, fresh pre-mix is continuously added to the un-separated mixture. The pre-mill mixture of pre-mix, milled dispersion, and media is then sent through a mill or series of mills, which starts the cycle over again. In this way, the media is contained within the small volume of the mill, the connecting pipes, and the separation unit. This process needs significantly less milling media than other processes, which have a small difference in the density of the media and dispersion. The process is continuous and includes both milling and separating concurrently. The need for less milling media reduces the problems associated with media storage because when incompatible products are made different media must be used. However, when only small amounts of media are used the media can be efficiently cleaned instead of stored, laden with dispersion. In addition, this process is more energy efficient than other ceramic media milling processes using dense media because of a much smaller milling mass, allows for high throughput, produces small particle size within reasonable milling times, has low contamination of metals, results in low mill wear, and allows the use of low cost long lasting media.

Dispersion

During the process, a pre-mill mixture is formed of pre-mix, milling media, and previously milled dispersion. The pre-mix comprises a liquid, such as water, ethanol, or organic solvents; a solid, such as a pigment; and optionally comprises other ingredients, such as resins, surfactants, dispersants, biocides, etc. The step of forming the pre-mill mixture may be carried out in any way, such as, but not limited to, by forming the pre-mill mixture in a feed vessel; by combining the pre-mix, milling media, and previously milled dispersion before they enter the mill; or by combining the pre-mix, milling media, and previously milled dispersion in the mill.

In some embodiments, the solids in the dispersion are selected from pigments, such as organic or inorganic pigments; amorphous dyes; crystalline dyes; extenders; medicinal solids; clays; metals; polymers; resins; inorganic materials; organic materials; carbon nanotubes; graphene; graphite; and other solids. In some embodiments, the solids are selected from organic pigments, inorganic pigments, amorphous dyes, crystalline dyes, and combinations thereof. In pre-milled form the solids can range from a few tens of microns down to a few hundred nanometers with generally broad particle size distributions. Post-milled solids can range from a few hundred nanometers to tens of nanometers or even smaller with generally smaller particle size distributions than the pre-milled solids.

In some embodiments, the liquid in the liquid medium is selected from polar solvents, such as water, ethanol, butanol, propanol, n-propanol, glycol monoethers, and acetates; mid-polar solvents, such as ketones; and non-polar solvents, such as toluene and hydrocarbons. In some embodiments, the liquid is selected from water, ethanol, butanol, propanol, n-propanol, acetates, ketones, toluene, hydrocarbons, and mixtures thereof. In some embodiments, the liquid is water. In some embodiments, the liquid is a mixture of two or more solvents. In some embodiments, the composition of the liquid is changed during the continuous process.

In some embodiments, the recycling step, that of mixing the pre-mix, milling media, and previously milled dispersion, is performed in at least one mill simultaneously with the milling step. In some embodiments, the recycling step, that of mixing the pre-mix, milling media, and previously milled dispersion, is mixed in a feed vessel before being introduced to at least one or more mill.

The milled dispersion or final dispersion can be used in virtually any end use where coloration is desirable. This includes inks, paints, coatings, plastics, cosmetics, pharmaceuticals, filter cakes, etc. The milled dispersion is more stable than the pre-mix and in some embodiments, has a higher color value, better gloss, more transparency, and higher chromaticity. In some embodiments, the milled dispersion is a nano-particle dispersions (with D50 particle size of about 200 nm and less) of solid particles in liquid medium.

Milling Media

The milling media is used to convert the pre-mix into milled dispersion by reducing the mean particle size of the solids and often reducing the particle size distribution in the liquid medium. In some embodiments, the milling media is selected from ceramics, metallic such as steel, silicates such as sand or glass, undissolved resins, polymers, and starches. Additional description of milling media is found in U.S. Pat. No. 7,441,717, and U.S. Patent Publication No. 2003/0289137, which are herein incorporated by reference in their entirety.

In some embodiments, the shape of the milling media includes but is not limited to, particles, such as ones with a substantially spherical shape, such as beads, although cubes may be used. In some embodiments, other shapes and forms may be used either alone or in combination. Examples include spherical, ovoid, cylindrical, cuboid, cube, etc., or any configuration having a uniform or non-uniform aspect ratio.

In some embodiments, the milling media is polymeric. Polymeric media have the advantage of reducing contamination by inorganic materials, reducing wear on milling components, and requiring less energy to move because of reduced density. The drawback of using polymeric media is that separation from the dispersion is more difficult because centripetal separation methods are ineffective when the media and dispersion density are similar. This drawback to conventional use of polymeric media is not detrimental to this process because the separation step only removes a portion of the dispersion. This reduces the requirements for the separation and is less time consuming than traditional vacuum separation techniques. Separation techniques for batch processes need to remove nearly all of the dispersion at once.

In general, the polymeric resins are chemically and physically inert, substantially free of metals, solvents and monomers, and of sufficient hardness and friability to enable them to avoid being chipped or crushed during milling. Suitable polymeric resins include, but are not limited to: cross linked polystyrenes, such as polystyrene cross linked with divinyl benzene; styrene copolymers; polycarbonates; polyacetals, such as Delrin™; vinyl chloride polymers and copolymers; polyurethanes; polyamides; poly(tetrafluoroethylenes), e.g., Teflon™ and other fluoropolymers; high density polyethylenes; polypropylenes; cellulose ethers and esters, such as cellulose acetate; polyacrylates, such as polymethyhnethacrylate, polyhydroxymethacrylate and polyhydroxyethyl acrylate; and silicone containing polymers, such as polysiloxanes and the like. More than one type of polymeric resin may be used at the same time. In some embodiments, the polymer is biodegradable. Exemplary biodegradable polymers include, but are not limited to: poly(lactides), poly(glycolide), copolymers of lactides and glycolide, polyanhydrides, poly(hydroxyethyl methacrylate), poly(iminocarbonates), poly(N-acylhydroxyproline)esters, poly(N-palmitoyl hydroxyproline esters, ethylene-vinyl acetate copolymers, poly(orthoesters), poly(caprolactones), and poly(phosphazenes).

In some embodiments, non-polymeric milling media types may be used alone or in combination with each other and/or also in combination with polymeric media types. For example, the milling media can comprise particles comprising a non-polymeric core having a coating of a polymeric resin adhered thereon. Examples of non-polymeric media that could be used alone or in combination with polymeric types include, but are not limited to, ceramics, metallics, and silicates, such as sand or glass.

In some embodiments, the size of the milling media ranges from a few hundred microns to tens of microns, such as about 500 microns to about 10 microns, about 300 microns to about 10 microns, about 200 microns to about 10 microns, about 100 microns to about 10 microns, about 50 microns to about 10 microns, about 300 microns to about 50 microns, and about 300 microns to about 100 microns. In general, smaller milling media leads to smaller particle size dispersions which often have favorable properties such as high gloss, enhanced color value, and brighter colors.

In some embodiments, the bulk density of polymeric milling media ranges from about 1.5 to about 0.7 g/ml, such as about 1.2 to about 0.7 g/ml, about 1.0 to about 0.7 g/ml, about 0.9 to about 0.7 g/ml, about 1.5 to about 0.9 g/ml, about 1.5 to about 1.0 g/ml, and about 1.5 to about 1.2 g/ml. In some embodiments, inorganic media have bulk densities exceeding about 2 g/ml, such as about 2 to about 6 g/ml, about 2 to about 5 g/ml, and about 2 to about 3 g/ml. In some embodiments, the inorganic media is hollow or air impregnated inorganic media so it has a lower bulk density. In some embodiments, the density difference between the milling media and the dispersion is about 5 g/ml to about −0.3 g/ml, such as about 4 g/ml to about 0 g/ml, about 3 g/ml to about 0 g/ml, about 2 g/ml to about 0 g/ml, about 1 g/ml to about 0 g/ml, about 0.5 g/ml to about 0 g/ml, about 0.4 g/ml to about 0 g/ml, about 0.2 g/ml to about 0 g/ml, about 0.1 g/ml to about 0 g/ml, about 0 g/ml, about 1 g/ml to about −0.3 g/ml, about 0.5 g/ml to about −0.3 g/ml, or about 0.1 g/ml to about −0.1 g/ml.

Mill

One or more mills are used to mill the pre-mill mixture. When more than one mill is used, they may be used in series, parallel, or a combination of both. The number of mills in series and the average number of cycles the dispersion passes through the mill is used to control the average particle size and the breadth of the distribution. When mills are used in parallel it increases the throughput of the process.

The mill introduces shear forces to mill the pre-mill mixture into a milled dispersion. The media reduces the shear gaps thereby magnifying the shear rate. In some embodiments, one or more mills are selected from a rotor stator, an in-line disperser, a vertical media mill, a horizontal media mill, a tank and disperser, a tank and an overhead rotor stator, an impingement mill, an ultrasound mill, and a vibratory mill. In some embodiments, the media mill is a rotor stator.

In some embodiments, the continuous milling process is started by charging the mill with previously milled dispersion and milling media. The mill is started and the previously milled dispersion and milling media is circulated though the separator. Once the circulation has started, premix is added and the separator starts to separate a portion of the milled dispersion.

Separator

The separator separates a portion of the milled dispersion from the milled mixture of the milled dispersion and milling media. The separated portion is substantially free of milling media. Substantially free of milling media means that there is a small amount of milling media present which may be easily removed by filtering procedures known in the art. In some embodiments, substantially free means less than about 5%, less than about 4%, less than about 3%, less than about 2%, less than about 1%, less than about 0.5%, less than about 0.25%, less than about 0.1%, or less than about 0.05%. In some embodiments the separated portion is free of milling media.

The amount of the separated portion of milled dispersion depends upon the purpose and the process. In some embodiments, the separation percentage is about 0.01% to about 45% by mass of the total dispersion and milling media circulation; such as about 0.1% to about 35%, about 1% to about 25%, about 1% to about 20%, about 1% to about 15%, about 1% to about 10%, about 5% to about 25%, about 5% to about 15%, about 5% to about 10%, about 10% to about 25%, about 10% to about 15%, or about 15% to about 25%. The separation percentage is the percentage of the rate of flow of the separated milled dispersion compared to the rate of flow of the milled mixture into the separator. In some embodiments, the separated portion is a finished product. In some embodiments, the separated portion more processing to be made into a finished product.

In some embodiments, the separator is selected from a drum filter, a screw press, a pressure screen filter, a non-pressure screen filter, a sieve, fiber filter, and a micron pored-filter or porous filter. In some embodiments, the separator is selected from a screw press or a drum filter separator. In some embodiments, the separator is a screw press (or auger press). The separator may be a single separator or more than one separator. If there is more than one separator, they may be used in series or parallel. The driving force for the separator may be pressure, gravity, vacuum, centrifugal, vibration, ultrasonic, or magnetic.

The major features of a screw press include a feed hopper, a motor driven conveying screw, a separating screen, and a back pressure device. The feed hopper receives the liquid-solid milled mixture to be processed, which is conveyed forward by an auger that is specially designed to develop pressure within the cylindrical region encapsulated by the separating screen. The auger consists of toroidal flighting on a conical shaft. As the solids progress from the feed end to the discharge end, the auger shaft increases in diameter and the spacing between the auger flights decreases, thus decreasing the carrying capacity of the auger. As a result, the solids being conveyed forward develop pressure until the pressure is relieved by the back pressure device. This device, commonly a conical metal piston, is driven forward typically by an air cylinder or spring, imparting a resistance to discharge of the solids mass. When the pressure built within the solids exceeds the adjustable pressure imparted by the air cylinder or spring, the cone or other back pressure device is pushed slightly away from the cylinder allowing solids to exit the press in a continuous fashion. The auger may optionally contain another pressure building feature, such as pins inserted into the cylinder, necessitating notched or interrupted auger flights. The pins impart further resistance and resultant back pressure on the solids. The solids mass increases by the continuous and sufficiently voluminous removal of liquid (typically water) through a porous separating screen.

The separating screen of the screw press is designed specifically to remove solids that are non-fibrous and much smaller than those encountered in typical screw press operation. Screw presses are typically used to separate fibrous solids from water, or to squeeze some liquid product from solids. Examples include citrus peels, potato peels, sugar cane and cranberries. The present process is unique because the screw press is used to remove milling media, such as polymeric milling media, which is non-fibrous and very small, such as less than 300 microns. The screen pore size and or geometry must be smaller than the milling media. In some embodiments the screen is constructed with discrete pores or porous metal or plastic.

In some embodiments, the separator is a pressure filter. The separation mechanism relies on a separating screen of a pore size at least about 2-3 times smaller than the milling media. The milled mixture of milling media and milled dispersion to be separated is fed under positive pressure, such as by use of a peristaltic pump or a gear pump. After the milled mixture enters the interior of the cylindrical filter chamber of the pressure filter, it may be restricted by a valve on the outlet side and allowed to fill the chamber until pressure builds to a desired level. The desired pressure level can be high if required to force filtrate through the screen, in which case the restricting valve is at first completely shut and then opened when the desired pressure is achieved. In this mode the outlet valve cycles open and closed repeatedly and alternately filling and emptying the chamber. Alternatively, the restricting valve may be partially closed thus keeping the chamber full under a low pressure in which case the filter operates with no cycling operation. If the filtrate passes through the screen easily, the chamber can operate partially full with little or no outlet restriction although this mode reduces filter area utilization. In some embodiments, the filter may incorporate a motor driven wiper blade to clean the screen and convey solids to the outlet. In some embodiments, the filter may be equipped with an outer jacket to accomplish temperature control of the process stream. In some embodiments, there is no restricting valve on the pressure filter, or the valve is not closed at all.

In some embodiments, the separating screen has heterogeneous pore sizes from about 500 microns to about 1 microns, such as about 400 microns to about 1 microns, about 300 microns, to about 1 microns, about 300 microns to about 10 micron, about 300 microns to about 20 microns, about 200 microns to about 10 micron, and about 100 microns to about 10 micron. In some embodiments, the separating screen has homogeneous pore sizes, wherein the pore size is about 500 microns to about 1 microns, such as about 400 microns to about 1 microns, about 300 microns, to about 1 microns, about 300 microns to about 10 micron, about 300 microns to about 20 microns, about 200 microns to about 10 micron, and about 100 microns to about 10 micron.

In some embodiments, the separating screen is constructed from porous metal or porous plastics. The porous cylinder may be assembled into a complete and functional screw press screen by weld attachment of standard pipe flanges to either end of the tube, allowing its attachment to the feed hopper and back pressure device. In some embodiments, the completed separating screen is reinforced against rupture due to the developed pressure by conventional techniques known in the industry, such as longitudinal reinforcing bars between the end flanges.

DRAWINGS DESCRIPTION

FIG. 1 depicts a schematic view of the continuous dispersion production process. The mill is a rotor stator (1) and the separator is a disposable rotary drum filter (2). The feed vessel is a stainless steel jacketed vessel (4). The pre-mill mixture 22 of the pre-mix and milling media in the feed vessel (4) is agitated by a stirrer (3). A peristaltic pump (5) transfers the pre-mill mixture (22) through the rotor stator (1). The rotational speed of the rotor stator (1) is controlled by its variable frequency controller (6). The milled mixture of the milling media and milled dispersion enters the drum filter (2) filling the lower chamber until overflow (7) occurs back to the stirred feed vessel (4). The rotational speed of the drum filter (2) is set by the motor drive speed controller (8). Vacuum is produced by the bench top vacuum pump (9) and the desired level of vacuum (such as 10-15 inches of Hg) is controlled by introducing air via a needle valve (10) and monitoring the vacuum gauge (11). Filtered milled dispersion (12) is transferred to a vacuum receiving vessel (13) and the product level in this vessel is held at a constant level by adjustment of the peristaltic outlet pump (14). The milled dispersion (15) production rate is monitored by a weighed receiving vessel (16) and an equivalent amount of fresh pre-mix is metered to the feed vessel (4) through a metering valve (17) from a weighed and agitated pre-mix storage vessel (18). A vacuum trap vessel (19) prevents the entry of stray droplets of milled dispersion into the vacuum pump (9). Chilled water (20, 21) from a recirculating plant utility system is applied to the feed vessel jacket (50) and the internal space of the rotor stator (1) mill.

Figure 2:
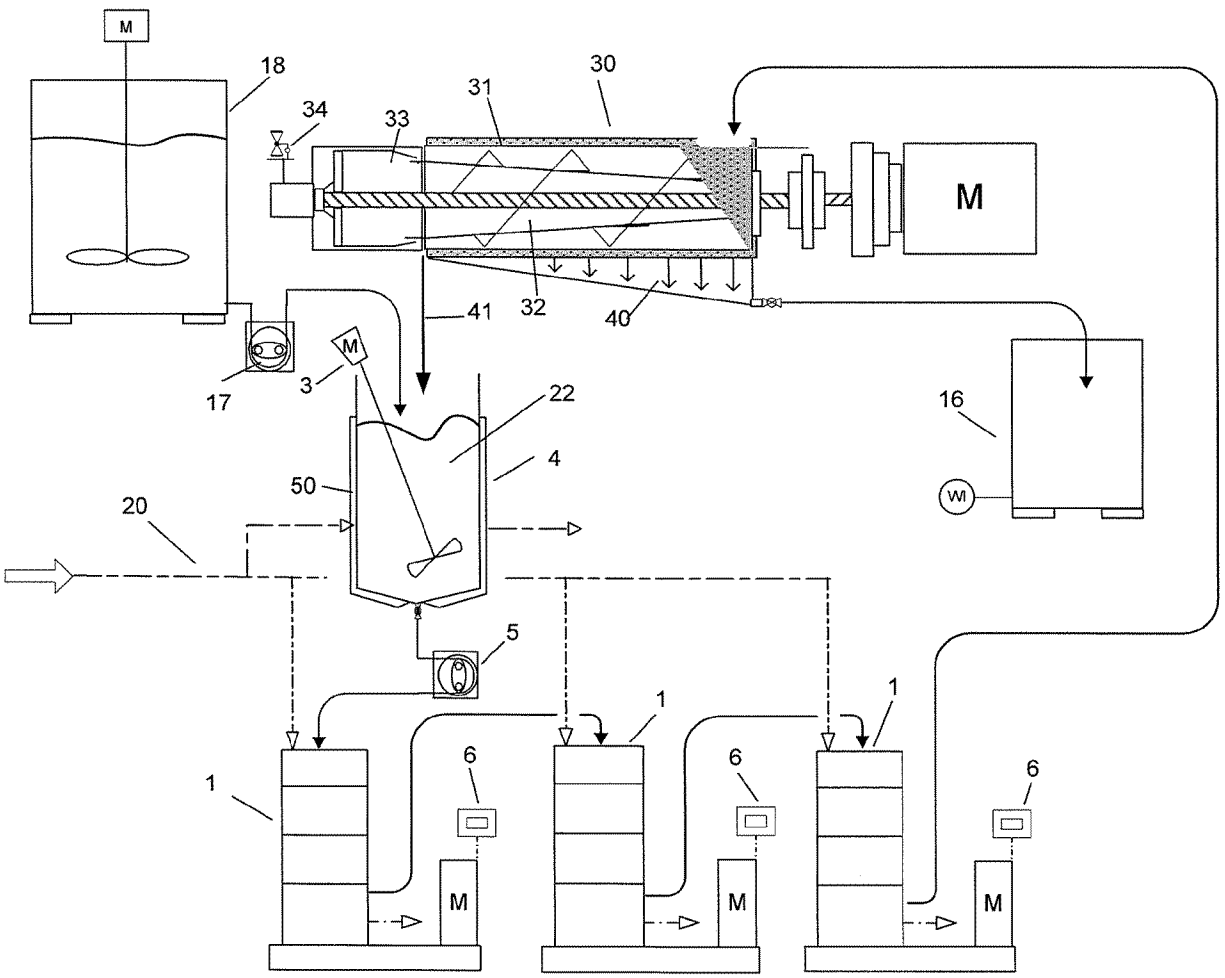
FIG. 2 is a schematic view of one embodiment of the apparatus and continuous process using a modified screw press.

FIG. 2 depicts a schematic view of the continuous dispersion production process with three in-line rotor stator (1) mills operated in series with a screw press (30) as the separator. The feed vessel is a stainless steel jacketed vessel (4). The pre-mill mixture of the pre-mix and milling media (22) in the feed vessel (4) is agitated by a stirrer (3). A peristaltic pump (5) transfers the pre-mill mixture (22) through a series of in-line rotor stators (1). The rotational speed of each rotor stator (1) is controlled by its variable frequency controller (6). The milled mixture of the milling media and milled dispersion enters the screw press (30) which has its typical wedge wire screen replaced with a porous metal screen (31). The internal auger (32) is designed to increase pressure along the length of the barrel forcing the milled dispersion (40) through the porous metal screen (31) where it is collected at a measured rate in a weighed receiving vessel (16). Solids (41) discharge from the screw press (30) is aided by a rotating cone (33) which puts opposing pressure on the solids cake (41) to increase the flow of milled dispersion (40) through the screen (31) and thus produce a drier solids cake (41). An air pressure regulating valve (34) is adjusted to achieve the desired dispersion production rate. Fresh pre-mix is continuously introduced to the feed vessel (4) from the pre-mix storage vessel (18) through a peristaltic pump (17). At all times, chilled water (20) from a recirculating plant utility system is applied to the feed vessel jacket (50) and the internal spaces of the rotor stator (1) mills.

Figure 3:
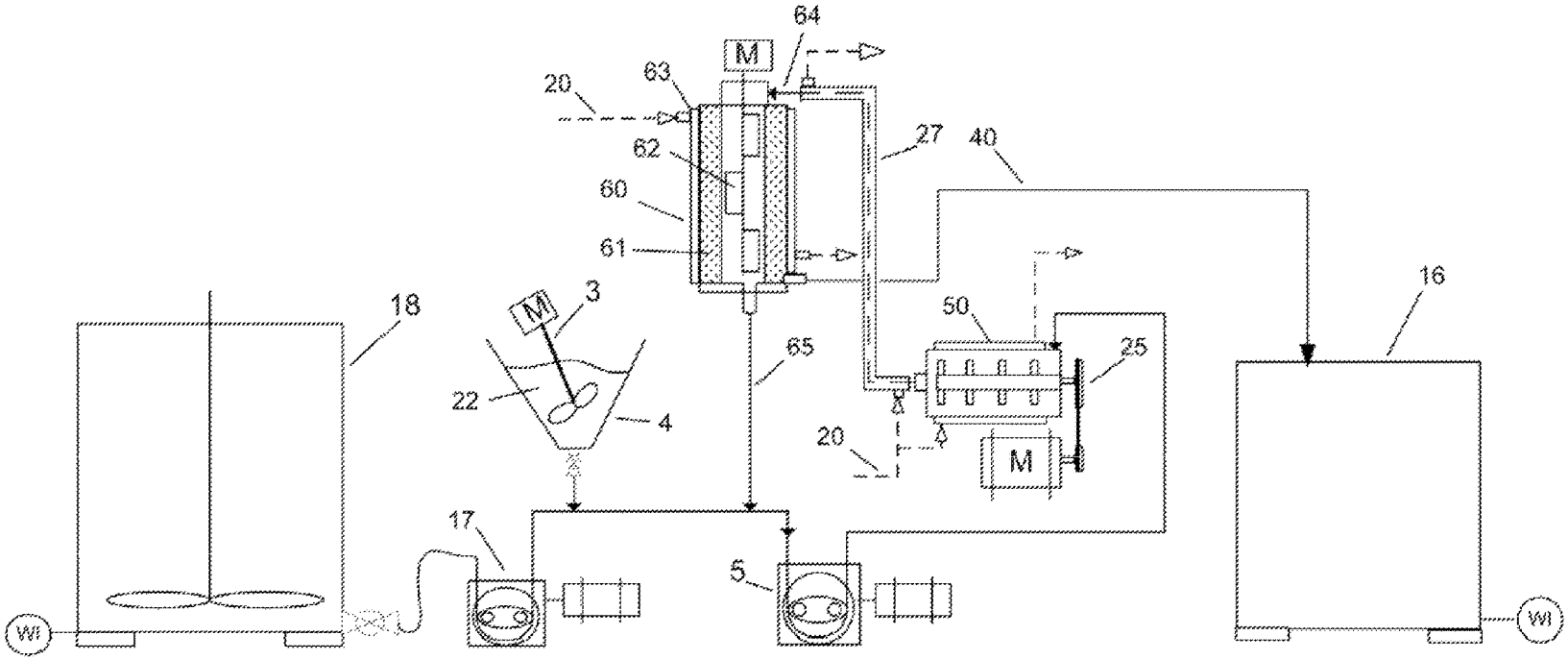
FIG. 3 is a schematic view of one embodiment of the apparatus and continuous process using a pressure filter.

FIG. 3 depicts a schematic view of the continuous dispersion production process with a high speed recirculation mill (25) with a pressure filter (60) as the separator. The feed vessel is a stainless steel jacketed vessel (4). The pre-mill mixture of the pre-mix and milling media (22) in the feed vessel (4) is agitated by a stirrer (3). A peristaltic pump (5) transfers the pre-mill mixture of the pre-mix and milling media (22) and the un-separated mixture of milling media and milled dispersion (65) to the high speed recirculation mill (25). The milled mixture of the milling media and milled dispersion flow through a self cleaning filter (27) and enters the pressure filter (60) by the pressure filter inlet port (64). The pressure filter (60) is equipped with a filter screen (61), motor driven wiper blades (62) for continuous cleaning of the filter screen (61) and a cooling jacket (63). As recycle flow of un-separated mixture of milling media and milled dispersion (65) is established. The milled dispersion (40) flows through the filter screen (61) into a weighed receiving vessel (16). Fresh pre-mix is continuously introduced to the feed vessel (4) at the same rate that milled dispersion (40) is collected, from the pre-mix storage vessel (18) through a metering valve (17). At all times, chilled water (20) from a recirculating plant utility system is applied to the feed vessel jacket (50) and the internal spaces of the high speed recirculation mill (25).

EXAMPLES

Example 1A—In-Line Rotor Stator with Drum Filter Separation Unit vs. Comparative Example 1B A system was assembled as depicted in FIG. 1. An in-line rotor stator, model DR 2000/4 as manufactured by the IKA Works Inc., was equipped with the DR three stage high shear rotor stator module, and was fed from a peristaltic pump. The feed tank for the pump was a four liter stirred stainless steel tank jacketed for cooling with chilled water at 5° C. The feed tank was filled with 1590 grams of an aqueous pre-mix consisting of 25.0% Yellow 14 pigment, 41.8% Joncryl 674 liquid resin, 0.20% BYK 1719 defoamer and 33% water, which was pre-blended for 60 minutes with a Cowles blade mixer running with a tip speed of 12 meters per second. To the pre-mix in the four liter, stirred feed tank was added 1410 grams of toughened polystyrene media with a size range of 0.15 to 0.25 mm (sphere) as supplied by the Glen Mills Inc. of Clifton, N.J. The media was allowed to blend with the blade stirrer approximately five minutes until thoroughly wetted.

Above the tank was situated a disposable laboratory drum filter as manufactured by the Steadfast Equipment Company of Mill Creek, Wash., with a drum membrane composed of Ultrahigh Molecular Weight Polyethylene (UHMWPE) with a nominal pore size of 15-45 microns. The drum filter was driven with a 1/15 HP variable speed drive also supplied by the Steadfast Equipment company.

In operation, the stirred pre-mill mixture was pumped at a rate of 1 kg/min to the IKA rotor stator running at a tip speed 19 m/s by adjusting its variable frequency drive to 50 HZ. The milled mixture was then added to the drum filter at the 1 kg/min rate until the product in the bottom bowl of the drum filter reached overflow level. This product recirculation operation at 1 kg/min continued with no product removal for twelve minutes or until the 3 kg milled mixture has passed through the rotor stator for four theoretical passes.

The filter drum was then rotated at 4 rpm via its variable frequency drive. Simultaneously, the downstream laboratory vacuum pump (Gardner Denver model 2585B-01) was started and the vacuum level was adjusted to approximately 10 inches Hg by manual adjustment of inlet air valve. The vacuum level controls the outlet flow of dispersion through the drum filter to a desired rate of 125 g/min, which has been shown to optimally balance the desired production rate with the required residence time of product in the rotor stator system. The production rate was monitored on a laboratory scale as the product was continually pumped from the vacuum receiver (sealed two liter Erlenmeyer flask) with another peristaltic pump. Another sealed two liter Erlenmeyer flask was placed between the product receiver and the vacuum pump to trap residual liquids and prevent their entry into the vacuum pump. Recovered media composed of approximately 70% dry media and 30% entrained dispersion was continuously scraped from the drum surface and fell by gravity into the stirred vessel. Simultaneous to the product withdrawal, fresh pre-mix was added to the stirred vessel at a controlled rate to match the rate of product withdrawal.

The system was allowed to run continuously for any amount of time such that a desired level of dispersion was processed. At that time, pre-mix additions were stopped and the filtration system continues to operate until the stirred vessel was emptied. This is Example 1A. The dispersion removed from the vacuum receiver was collected and analyzed for particle size distribution for comparison against a plant test standard.

Comparative Example 1B was produced by current best manufacturing methods starting with the same lot of pigment that was used in Example 1A. The pre-mill mixture was milled in two consecutive passes through a 200 liter horizontal Premier media mill as supplied by the SPX Corporation, using 0.8 mm zirconia silica grinding media. This is Comparative Example 1B.

The particle size distribution of Example 1A was measured with a dynamic light scattering particle size analyzer and found to be improved over Comparative Example 1B as shown in Table 1. Next, the pigment percentage contents of Example 1A and Comparative 1B were verified to be 25.0% and 23.1% respectively. The tint strength of Example 1A was evaluated by blending 50 parts of Porter 691 interior flat latex paint to 1 part Example 1A dispersion. A comparison tint sample was prepared with 50 parts of the paint to 1.082 grams of Comparative Example 1B dispersion to produce tint samples of equal pigment concentration. The tint samples were drawn down with a #30 Meyer rod on Leneta 3NT coated paper and evaluated with a hand held 0°/45° spectrophotometer indicating the improved tint strength for Example 1A as shown in Table 1.

Example 2A—Rotor Stators in Series with Auger Separator vs. Comparative Example 2B A system was assembled as depicted in FIG. 2. A series of three in-line rotor stators (identical to those in Example 1A), was fed from a peristaltic pump. The feed tank and pump were identical to those described in Example 1A.

The feed tank was filled with 1500 grams of an aqueous pre-mix consisting of 30% Violet 3 (methyl violet) pigment, 32% Joncryl 674 liquid resin, 0.20% BYK 1719 defoamer, and 37.8% water which was pre-blended for 60 minutes with a Cowles blade mixer running with a tip speed of 12 meters per second. To the pre-mix was added 1100 grams of toughened polystyrene media with a size range of 0.15 to 0.25 mm (sphere) as supplied by Glen Mills Inc. of Clifton, N.J.

The pre-mill mixture was pumped once through the series of three in-line rotor stators at a rate of 1 kg/min. The tip speed of the dispersers was set at 17 m/s and cooling was provided with chilled water piping to the in-line rotor stator mixing head.

The milled dispersion was then separated from the milled mixture in a modified model CP-4 screw press manufactured by the Vincent Corporation of Tampa, Fla. The screw press modification depicted in FIG. 2 was created by replacing the standard wedge wire cylindrical screen with a porous metal screen of equivalent length and diameter. The porous metal as manufactured by the Mott Corporation of Farmington, Conn., made of 316L stainless steel porous grade 40, retains 100% of the polystyrene media while permitting an outward flux rate of dispersion sufficient for practical scale up to a production size. The rotating cone restriction on the screw press outlet was placed in the closed position under 40 psig of compressed air on the air cylinder mechanism. The peristaltic pump was started and the screw press hopper was allowed to fill until the internal auger was just covered with the feed mixture. The screw press was started and its speed controlled to 50 RPM. As the filtrate escaped from the screen it was collected in a catch pan and diverted to a weighed receiving vessel. The outlet flow rate was measured at 83 g/minute while the un-separated mixture of polystyrene media and milled dispersion (approximately 30% on a mass basis) was returned to the feed tank. Fresh pre-mix was added and mixed with the un-separated mixture in the feed tank, at the same rate as the milled dispersion was withdrawn.

The system was allowed to run continuously for any amount of time such that a desired level of dispersion was processed. At that time, pre-mix additions were stopped and the filtration system continued to operate until the stirred vessel was emptied. This is Example 2A.

The Example 2A dispersion was analyzed for particle size distribution for comparison against a Comparative Example 2B dispersion that was produced from the same pre-mix material used in Example 2A. Example 2B was produced by 30 minutes of recirculation milling in a 50 ml horizontal laboratory bead mill as manufactured by Engineered Mills, Inc of Grayslake, Ill., using 0.8 mm zirconia silica grinding media. The particle size distribution of Example 2A was measured with a dynamic light scattering particle size analyzer and found to be improved versus the Comparative Example 2B as shown in Table 1. The solids contents of Example 2A and Comparative Example 2B were measured at 43.13% and 44.96% respectively. The tint strength of Example 2A was evaluated vs. Comparative Example 2B by blending each sample to a concentration of 4.1% solids in a solution of PMA 023 flexographic ink vehicle. The tint samples were drawn down with a #3 Meyer rod on Leneta 3NT coated paper and evaluated with a hand held 0°/45° spectrophotometer indicating the improved tint strength for Example 2 as shown in Table 1.

Example 3A—Rotor Stators in Series with Auger Separator—Residence Time Adjustment vs. Comparative Example 3B The system of Example 2A was operated again with a dispersion formula, which is known to typically require less milling residence time than the Violet 3 dispersion of Example 2A. The pumping rate was increased to achieve a faster withdrawal rate and corresponding lower residence time within the mill.

The feed tank was filled with 1500 grams of an aqueous pre-mix consisting of 36.8% PR122 quinacridone magenta pigment, 27.9% phosphate ester surfactant, 35.1% water and 0.2% BYK 1719 defoamer which was blended 60 minutes with a Cowles blade mixer running with a tip speed of 12 meters per second. To the pre-mix was added 1000 grams of toughened polystyrene media with a size range of 0.15 to 0.25 mm (sphere) as supplied by the Glen Mills Inc. of Clifton, N.J.

The pre-mill mixture was pumped once through the series of three in-line rotor stators at a rate of 1.73 kg/min. The tip speed of the rotor stator was set at 17 m/s and cooling was provided with chilled water piping to the in-line rotor stator mixing head.

The milled dispersion was then separated in the modified screw press. The outlet product flow rate was measured at 143 grams/minute while the polystyrene media and entrained dispersion (approximately 30% on a mass basis) was returned to the system via the feed tank. Fresh pre-mix was then introduced to the system at the feed tank at the same rate as the product was withdrawn.

The process was allowed to run continuously for an amount of time such that a desired level of dispersion was processed. At this time, pre-mix additions were stopped and the filtration system continued to operate until the stirred vessel was emptied. This is Example 3A.

The Example 3A was analyzed for particle size distribution for comparison against Comparative Example 3B that was produced from the same pre-mix material used in the Example 3A. Example 3B was produced by 30 minutes of recirculation milling in a 50 ml horizontal laboratory bead mill as manufactured by Engineered Mills, Inc of Grayslake, Ill., using 0.8 mm zirconia silica grinding media. The particle size distribution of Example 3A was measured with a dynamic light scattering particle size analyzer and found to be improved over Comparative Example 3B as shown in Table 1. Next, the solids contents of Example 3A and Comparative Example 3B were measured at 40.06% and 40.20% respectively. The tint strength of Example 3A was then evaluated versus Comparative Example 3B by blending each sample to a concentration of 34.51% solids in a solution of PMA 023 flexographic ink vehicle. The tint samples were drawn down with a #3 Meyer rod on Leneta 3NT coated paper and evaluated with a hand held 50°/65° spectrophotometer indicating the improved tint strength for Example 3A as shown in Table 1.

TABLE 1

Experimental Results from Continuous Contained Milling Examples.

| | Particle Size Distribution | | | Tint Strength |
|---|---|---|---|---|
| | D50 (nm) | D95 (nm) | Mean Value (nm) | Chromatic % Strength |
| Example 1B (Comparative) | 212.6 | 440.0 | 231.4 | 100.0 @ 605 nm |
| Example 1A | 149.2 | 304.0 | 160.6 | 125.9 @ 605 nm |
| Example 2B (Eiger Milled Comparative) | 184.3 | 347.0 | 192.2 | 100.0 @ 550 nm |
| Example 2A | 130.0 | 288.0 | 147.2 | 108.1 @ 550 nm |
| Example 3B (Eiger Milled Comparative) | 141.5 | 289.3 | 151.4 | 100.0 @ 550 nm |
| Example 3A | 127.8 | 238.5 | 134.3 | 121.3 @ 550 nm |
| Example 4B (Comparative) | 131 | 249 | 147 | 100 @ 605 nm |
| Example 4A | 82 | 155 | 93 | 109.8 @ 605 nm |

Example 4—Polymeric Media Separation with a Pressure Filter

A system was assembled as depicted in FIG. 3. A high speed recirculation mill model LMZ 2 as manufactured by the Netzsch Corporation with a 1.6 chamber volume was configured with a 0.4 mm wedge wire screen and fed with an onboard peristaltic pump from a 7 gallon stainless steel jacketed vessel.

The feed tank was filled with 7.5 lb of a solvent based pre-mix consisting of 20% SUNBRITE Yellow 13, 14-19% nitrocellulose varnish, 60-65% denatured ethanol, 1% ethyl acetate and less than 1% polypropylene glycol. To the premix was added 7.85 pounds of polystyrene media with a size range of 65 to 110 microns (sphere).

Between the recirculation mill and the feed tank was situated a Model 25 SCF Self Cleaning filter as manufactured by the Russell Finex company with an internal screen rated at a 20 micron pore size. The filter includes a 1/10 HP motor/gear reducer to drive Teflon scrapers that constantly clean the filter surface. A 1" globe valve fitted to the filter exit could be adjusted to provide slight back pressure on the filter contents.

In operation, the stirred mixture was pumped at a rate of 18.4 lb/min to the mill chamber with the agitator running at a tip speed of 12.2 m/s to achieve the target power input rate of 4.0 KW. Milled product was then added to the self-cleaning filter and the globe valve was slowly closed until a filter inlet pressure of 5 psi was observed yielding an outlet filtrate rate of 0.45 lb/minute. At this point, fresh pre-mix was added to the feed tank at an identical rate of 0.45 lb/minute. The system was allowed to run continuously. At this time, pre-mix additions were stopped and the internally circulated contents were off loaded to a small containment vessel. The media and product left within the system could be separated in a sieve plate shaker device or stored as a pre-charge for a future product run.

The filtered dispersion was collected and analyzed for particle size distribution and color strength for comparison against a production test standard control sample that was produced from the same lot of pre-mix by a two stage high speed recirculation milling step utilizing first 0.8 mm ceramic media and then 0.5 mm ceramic media imparting the maximum practical pigment strength development from the production scale milling arrangement. Next, the pigment percentage contents of the milled sample and the control sample were measured to be 21.4 and 17.4% respectively. The tint strength of the milled sample was then evaluated versus the plant standard by blending 50 parts of Porter 691 interior flat latex paint to 1 part of this milled dispersion. A comparison tint sample was prepared with 50 parts of the paint to 1.082 grams of the plant standard to produce tint samples of equal pigment concentration. The tint samples were drawn down with a #30 Meyer rod on Leneta 3NT coated paper and evaluated with an X-Rite color computer indicating the improved tint strength for this example as indicated in Table 1. The particle size distribution and color strength was found to be improved versus the standard as shown in Table 1.

While the present disclosure has illustrated by description several embodiments and while the illustrative embodiments have been described in considerable detail, it is not the intention of the applicant to restrict or in any way limit the scope of the appended claims to such detail. Additional advantages and modifications may readily appear to those skilled in the art.

What is claimed is:

1. A continuous process for making a milled solid in liquid dispersion comprising the steps of:

forming a pre-mill mixture of pre-mix, milling media, and previously milled dispersion;

milling the pre-mill mixture to form a milled mixture of milling media and milled dispersion in a mill;

separating a portion of the milled dispersion comprising the milled solid, which is substantially free of milling media, from the milled mixture, leaving a remaining milling mixture, of milling media and previously milled dispersion; and recycling the remaining milling mixture by adding additional pre-mix to form pre-mill mixture to create a continuous milling process; wherein the pre-mix comprises liquid and a solid;

wherein the milling media is polymeric and has a density difference between the milling media and milled dispersion of less than 0.5 g/ml; and wherein the separation percentage is 0.01% to 45%; the separation percentage is the percentage of the rate of flow of the separated milled dispersion compared to the rate of flow of the milled mixture into the separator.

2. The process of claim 1, wherein the milling step is performed in one or more mills, wherein each mill is selected from a rotor stator, an in-line disperser, a vertical media mill, a horizontal media mill, a tank and disperser, a tank and an overhead rotor stator, an impingement mill, an ultrasound mill, and a vibratory mill.

3. The process of claim 1, wherein the separating step is performed by one or more separators, wherein each separator is selected from a drum filter, a screw press, a pressure screen filter, a non-pressure screen filter, a sieve, fiber filter, and a micron pored-filter or porous filter.

4. The process of claim 3, wherein the screw press comprises a separating screen with a median pore size from 500 microns to 1 micron constructed with either discrete pores or porous metal or plastic.

5. The process of claim 3, wherein the pressure screen filter or non-pressure filter comprises a separating screen with a median pore size from 500 to 1 micron.

6. The process of claim 1, wherein the recycling step is performed in a feed vessel; wherein the feed vessel feeds the pre-mill mixture into at least one mill.

7. The process of claim 1, wherein the recycling step is performed in the mill.

8. The process of claim 1, wherein the recycling step is a direct injection of the un-separated dispersion into the flow of the pre-mill mixture before it enters the mill.

9. The process of claim 1, wherein the median particle size of the milling media is less than 500 microns.

10. The process of claim 1, wherein dispersion components comprise a solid selected from organic pigments, inorganic pigments, amorphous dyes, crystalline dyes, and combinations thereof, wherein the dispersion components comprise a liquid medium selected from water, ethanol, butanol, propanol, n-propanol, glycol monoethers, acetates, ketones, toluene, hydrocarbons, and mixtures thereof.

11. The process of claim 1, wherein the milled solid of the milled solid dispersion in a liquid medium is a pigment.

12. The process of claim 1, wherein the amount of dispersion components added to the un-separated mixture is equal to the amount of milled dispersion that is removed from the milled mixture.

13. An apparatus comprising a separator and a mill;

wherein the mill is structured to grind a pre-mill mixture comprising a milling media and solid or semi-solid particles in a liquid medium to form a milled mixture of milled dispersion with milling media;

wherein the apparatus is structured to allow the milled mixture to be fed into the separator;

wherein the separator is structured to separate a portion of the milled dispersion, which is substantially free of milling media, from the milled mixture, leaving a remaining milling mixture, of milling media and previously milled dispersion; and wherein the remaining milling mixture is fed directly or indirectly back into the mill;

wherein the milling media is polymeric and has a density difference between the milling media and milled dispersion of less than 0.5 g/ml.

14. The apparatus of claim 13, additionally comprising a feed vessel which is structured to receive the un-separated mixture from the separator; the un-separated mixture is mixed with additional solid or semi-solid particles in a liquid medium to foam a pre-mill mixture in the feed vessel; and the pre-mill mixture is fed into the mill.

15. The apparatus of claim 13, wherein there is one or more mill, and each mill is selected from a rotor stator, an in-line disperser, a vertical media mill, a horizontal media mill, a tank and disperser, a tank and an overhead rotor stator, an impingement mill, an ultrasound mill, and a vibratory mill.

16. The apparatus of claim 13, wherein there is one or more separator, and each separator is selected from a drum filter, a screw press, a pressure screen filter, a non-pressure screen filter, fiber, a micron pored-filter or porous filter, and a centripetal separator.

17. The apparatus of claim 16, wherein each separator is a screw press which comprises a separating screen with a median pore size from 1 to 500 microns constructed from either discrete pores or porous metal or plastic.

18. The apparatus of claim 16, wherein each separator is a pressure screen filter and is operated continuously, wherein the screen has a median pore size between 1 and 500 microns.

* * * * *